US007780270B2

(12) United States Patent
Lee et al.

(10) Patent No.: US 7,780,270 B2
(45) Date of Patent: Aug. 24, 2010

(54) HEATING STRUCTURE WITH A PASSIVATION LAYER AND INKJET PRINTHEAD INCLUDING THE HEATING STRUCTURE

(75) Inventors: Won-tae Lee, Hwaseong-si (KR); You-seop Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 472 days.

(21) Appl. No.: 11/769,105

(22) Filed: Jun. 27, 2007

(65) Prior Publication Data

US 2008/0170106 A1 Jul. 17, 2008

(30) Foreign Application Priority Data

Jan. 15, 2007 (KR) ..... 10-2007-0004417

(51) Int. Cl.
*B41J 2/05* (2006.01)

(52) U.S. Cl. ..... 347/62; 347/64

(58) Field of Classification Search ..... 347/20, 347/56–59, 61–65, 67

See application file for complete search history.

(56) References Cited

U.S. PATENT DOCUMENTS

| | | | | |
|---|---|---|---|---|
| 5,159,353 | A | 10/1992 | Fasen et al. | |
| 5,491,505 | A | 2/1996 | Suzuki et al. | |
| 6,848,772 | B2 * | 2/2005 | Kim | 347/63 |
| 6,902,256 | B2 * | 6/2005 | Anderson et al. | 347/56 |
| 2005/0012791 | A1 | 1/2005 | Anderson et al. | |

FOREIGN PATENT DOCUMENTS

| | | |
|---|---|---|
| JP | 2006-224604 | 8/2006 |
| KR | 2005-0062743 | 6/2005 |

OTHER PUBLICATIONS

Korean Office Action dated Oct. 26, 2007 issued in KR 2007-0004417.

European Search Report issued Feb. 12, 2009 in European Application No. 07121630.3

* cited by examiner

*Primary Examiner*—Juanita D Stephens
(74) *Attorney, Agent, or Firm*—Stanzione & Kim LLP

(57) ABSTRACT

A heating structure of an inkjet printhead and an inkjet printhead including the heating structure. The heating structure includes a substrate, a heater formed on the substrate, an electrode formed on the heater, a passivation layer formed to cover the heaters and the electrodes, and carbon nanotubes (CNTs) formed in the passivation layer.

22 Claims, 5 Drawing Sheets

HEATING STRUCTURE WITH A PASSIVATION LAYER AND INKJET PRINTHEAD INCLUDING THE HEATING STRUCTURE

CROSS-REFERENCE TO RELATED APPLICATIONS

This application claims the benefit of Korean Patent Application No. 10-2007-0004417, filed on 15 Jan. 2007, in the Korean Intellectual Property Office, the disclosure of which is incorporated herein in its entirety by reference.

BACKGROUND OF THE INVENTION

1. Field of the Invention

The present general inventive concept relates to an inkjet printhead, and more particularly, to a heating structure to improve performance of an inkjet printhead and a thermal inkjet printhead including the heating structure.

2. Description of the Related Art

An inkjet printhead is a device to print a predetermined color image by ejecting minute droplets of ink on a desired area of a printing paper. Inkjet printheads can be generally classified into two types according to the ejection mechanism of ink droplets. The first type is a thermal inkjet printhead that ejects ink droplets using the expansion force of ink bubbles created using a heat source, and the second type is a piezoelectric inkjet printhead that ejects inkjet droplets using a pressure created by the deformation of a piezoelectric element.

The ejection mechanism of ink droplets of the thermal inkjet printhead will be described in detail. When a pulse type current is applied to a heater composed of heating resistors, ink around the heater is instantly heated to approximately 300° C. Thus, the ink boils and bubbles are generated. Then, pressure is applied to the ink filled in an ink chamber by the expansion of the ink bubbles. As a result, ink droplets are ejected to the outside from the ink chamber through the nozzles in a droplet shape.

FIG. 1 is a cross-sectional view illustrating a conventional thermal inkjet printhead. Referring to FIG. 1, the conventional thermal inkjet printhead includes a substrate 10 on which a plurality of material layers are formed, a chamber layer 20 stacked on the plurality of material layers, and a nozzle layer 30 stacked on the chamber layer 20. A plurality of ink chambers 22, in which ink that is to be ejected is filled, are formed in the chamber layer 20. A plurality of nozzles 32 through which ink is ejected are formed in the nozzle layer 30. An ink feed hole 11 for supplying ink to the ink chambers 22 is formed in the substrate 10. Also, a plurality of resistors 24 that connect the ink chambers 22 and the ink feed hole 11 are formed in the chamber layer 20.

An insulating layer 12 for insulating a plurality of heaters 14 from the substrate 10 is formed on the substrate 10. The insulating layer 12 may be formed of silicon oxide. The heaters 14 are formed on the insulating layer 12 to generated ink bubbles by heating ink. Electrodes 16 are formed on the heaters 14. A passivation layer 18 for protecting the heaters 14 and the electrodes 16 is formed on surfaces of the heaters 14 and the electrodes 16. The passivation layer 18 may be formed of silicon nitride, silicon oxide, aluminum nitride or aluminum oxide. Anti-cavitation layers 19 for protecting the plurality of heaters 14 from a cavitation force generated when ink bubbles disappear are formed on the passivation layer 18. The anti-cavitation layer may be formed of tantalum Ta.

However, in the inkjet printhead having the above structure, since the passivation layer 18 formed on the heaters 14 is formed of a material having very small thermal conductivity, lots of heat generated from the heaters 14 is accumulated in the passivation layer 18 rather than being transmitted to ink in the ink chambers 22. Accordingly, the thermal efficiency of the heaters 14 may deteriorate, and a large amount of input energy for generating bubbles is required. In addition, the heat accumulated in the passivation layer 18 increases the temperature of the ink in the ink chambers 22 to change the viscosity of the ink, and thus the ejecting property of the inkjet printhead may deteriorate.

SUMMARY OF THE INVENTION

The present general inventive concept provides a heating structure to improve performance of an inkjet printhead and an inkjet printhead including the heating structure.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may also be achieved by providing a heating structure for an inkjet printhead, including: a substrate; a heater formed on the substrate; an electrode formed on the heater; a passivation layer formed to cover the heater and the electrode; and carbon nanotubes (CNTs) formed in the passivation layer.

The CNTs may be formed on the upper portion of a heating portion of the heater.

The CNTs may be perpendicularly aligned with respect to a surface of the heater.

The CNTs may be formed so as not to contact the heater.

The CNTs may be formed to have a height in the range of 0.05 to 1 μm.

The passivation layer may be formed of silicon nitride, silicon oxide, aluminum nitride, or aluminum oxide.

An anti-cavitation layer may be formed on the passivation layer positioned on the upper portion of a heating portion of the heater.

The anti-cavitation layer may be formed of tantalum (Ta).

The heater may be formed of one selected from the group consisting of a tantalum-aluminum alloy, tantalum nitride, titanium nitride, tantalum silicon nitride and tungsten silicide.

The electrode may be formed of aluminum (Al), an aluminum alloy, gold (Au), or silver (Ag).

The foregoing and/or other aspects and utilities of the present general inventive concept may also be achieved by providing a method of fabrication a heating structure for an inkjet printhead, the method including: forming a heater on a substrate; forming an electrode on the heater; forming a first passivation layer to cover the heaters and the electrodes; forming carbon nanotubes (CNTs) on the first passivation layer; and forming a second passivation layer on the first passivation layer to cover the CNTs.

The forming of CNTs may include forming a catalyst metal pattern on the first passivation layer, and growing the CNTs from the catalyst metal pattern.

The method may further include forming an anti-cavitation layer on the second passivation layer formed on the upper portion of a heating portion of the heater, after forming the second passivation layer.

The foregoing and/or other aspects and utilities of the present general inventive concept may also be achieved by providing an inkjet printhead including: a substrate through which an ink feed hole to supply ink is formed; a plurality of heaters formed on the substrate, and generating bubbles by heating ink; a plurality of electrodes formed on the heaters, and supplying currents to the heaters; a passivation layer formed to cover the heaters and the electrodes; carbon nanotubes (CNTs) formed in the passivation layer; a chamber layer stacked on the passivation layer, and including a plurality of ink chambers formed therein and filled with ink supplied from the ink feedhole; and a nozzle layer stacked on the chamber layer, and including a plurality of nozzles to eject ink.

The foregoing and/or other aspects and utilities of the present general inventive concept may also be achieved by providing a heating structure of an inkjet printhead, including: a substrate; a heater formed on the substrate; at least one electrode formed on the heater; a passivation layer formed to cover the heater and the electrodes; and a material having a high thermal conductivity formed within the passivation layer.

The foregoing and/or other aspects and utilities of the present general inventive concept may also be achieved by providing a method of fabricating a heating structure of an inkjet printhead, including: forming a heater on a substrate; forming at least one electrode on the heater; forming a first passivation layer to cover the heater and the at least one electrode; forming a material having a high thermal conductivity on the first passivation layer; and forming a second passivation layer on the first passivation layer to cover the material having the high thermal conductivity.

The foregoing and/or other aspects and utilities of the present general inventive concept may also be achieved by providing an inkjet printhead including: a substrate having an ink feedhole formed therein to supply ink; a plurality of heaters formed on the substrate to heat the ink; a plurality of electrodes formed on the heaters to supply currents to the respective heaters; a passivation layer formed to cover the heaters and the electrodes; a material having a high thermal conductivity formed within the passivation layer; a chamber layer stacked on the passivation layer, and comprising a plurality of ink chambers formed therein and filled with ink supplied from the ink feedhole; and a nozzle layer stacked on the chamber layer, and comprising a plurality of nozzles to eject ink.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
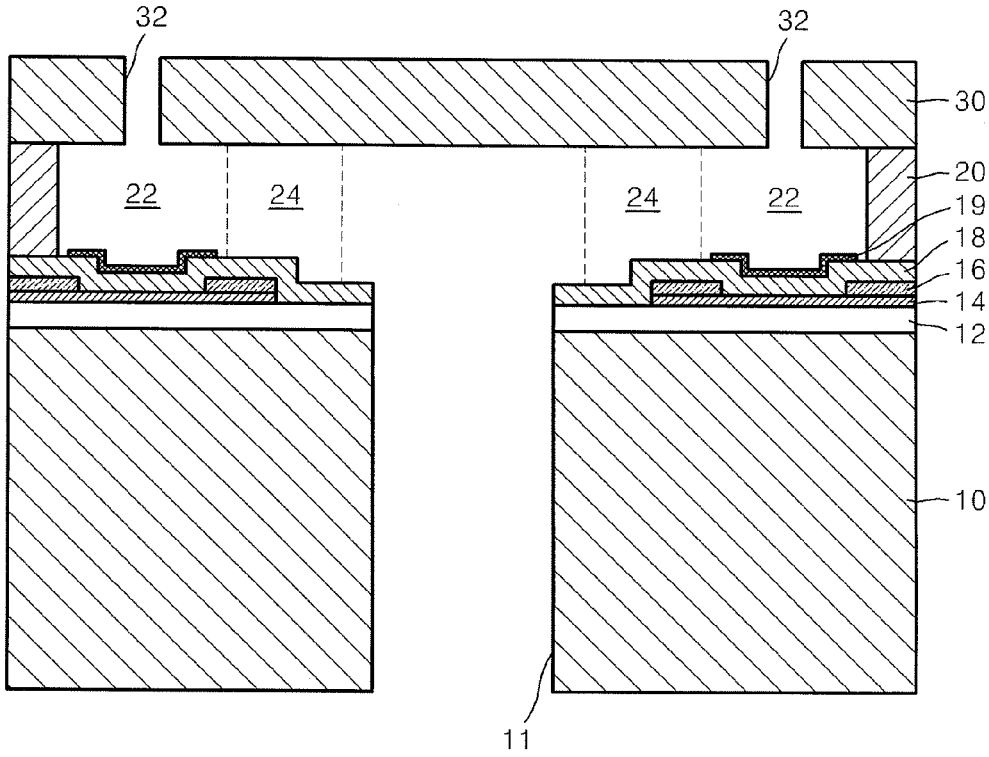
FIG. 1 (PRIOR ART)
FIG. 1 is a schematic cross-sectional view of a thermal inkjet printhead according to the conventional art.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
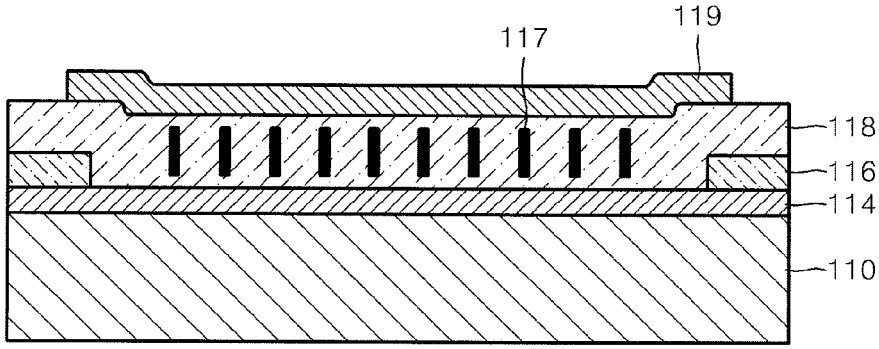
FIG. 2 is a cross-sectional view illustrating a heating structure of an inkjet printhead according to an embodiment of the present general inventive concept.
Figure 3:
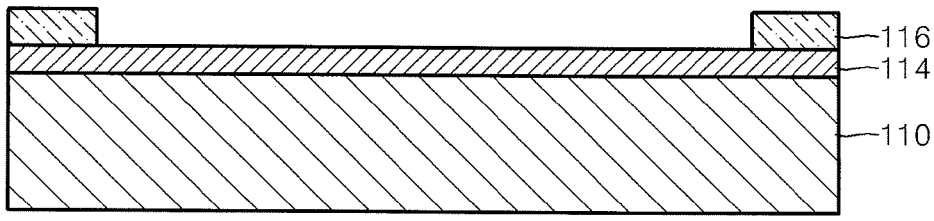
FIGS. 3 through 8 are views illustrating a method of fabricating the heating structure for an inkjet printhead of FIG. 2, according to an embodiment of the present general inventive concept.

FIG. 2 is a cross-sectional view illustrating a heating structure for an inkjet printhead according to an embodiment of the present general inventive concept.

Referring to FIG. 2, a heater 114 and electrodes 116 are sequentially formed on a substrate 110, and a passivation layer 118 is formed to cover the heater 114 and the electrode 116. The substrate 110 may be, for example, a silicon substrate. Although not illustrated, an insulating layer to insulate the substrate 110 from the heater 114 may be further formed on the substrate 110. The insulating layer may be formed of, for example, a silicon oxide. The heater 114 heats ink to generate bubbles therein, and are formed to have a predetermined shape on the substrate 110. The heater 114 may be formed of a heating resistor (e.g., a tantalum-aluminum alloy, tantalum nitride, titanium nitride, tantalum silicon nitride or tungsten silicide). The electrodes 116 are formed on an upper surface of the heater 114. The electrodes 116 apply currents to the heater 114, and may be formed of a metal having good conductivity (e.g., aluminum (Al), an aluminum alloy, gold (Au), or silver (Ag)).

The passivation layer 118 is formed to have a predetermined thickness on the substrate 110 and to cover the heater 114 and the electrodes 116. The passivation layer 118 prevents the heater 114 and the electrodes 116 from oxidizing or corroding due to contacting the ink. The passivation layer 118 may be formed of, for example, silicon nitride, silicon oxide, aluminum nitride, aluminum oxide or the like.

Carbon nanotubes (CNTs) 117 are formed inside the passivation layer 118. The CNTs 117 may be formed on the upper portion of the heater 114 exposed through the electrode 116, that is, on the upper portion of a heating portion of the heater 114. The CNTs 117 may be formed to be perpendicularly arranged with respect to an upper surface of the heater 114. The CNTs 117 may be formed so as not to contact the heater 114 in order to be insulated from the heater 114. However, the CNTs 117 may be formed to contact the heater 114 in an alternative exemplary embodiment. For example, the CNTs 117 may be formed to have a height in the range 0.05 to 1 μm.

An anti-cavitation layer 119 may be further formed on the passivation layer 118. The anti-cavitation layer 119 may be formed on the upper portion of the heating portion of the heater 114. The anti-cavitation layer 119 protects the heaters 114 from a cavitation force which is generated when bubbles burst, and may be formed of, for example, tantalum (Ta).

In the heating structure of an inkjet printhead having the above structure, the CNTs 117 improve thermal efficiency of the heater 114 by transferring most heat generated from the heater 114 to ink filled in an ink chamber. In particular, the CNTs 117 have a thermal conductivity of about 3000 W/mK, which is similar to that of diamond, and is much greater than those of other materials. Silicon nitride constituting the passivation layer 118 has a thermal conductivity of about 1.67 W/mK, which is much lower than that of other materials. The thermal conductivity of tantalum (Ta) constituting anti-cavitation layer 119 is about 57 W/mK.

As described above, when the CNTs 117 having a high thermal conductivity are formed in the passivation layer 118 having a low thermal conductivity, most heat generated from the heater 114 can be transferred to the anti-cavitation layer 119 through the CNTs 117. Accordingly, thermal efficiency of the heater 114 can be greatly improved as compared with the conventional art, and an input energy to generate appropriate bubbles required to eject ink can be reduced. Since bubbles can be generated within a short time, performance of the inkjet printhead can be improved. Conventionally, lots of heat generated from the heater (14 of FIG. 1) is accumulated in a passivation layer 18 (1 of FIG. 1). However, according to the current embodiment, since most heat generated from the heater 114 is transferred to the ink through the CNTs 117, heat can be prevented from being accumulated in the passivation layer 118. Accordingly, the ejecting property of the inkjet printhead can be improved.

Hereinafter, a method of fabricating the heating structure of an inkjet printhead will be described. FIGS. 3 through 8 are views illustrating a method of fabricating the heating structure for an inkjet printhead of FIG. 2, according to an exemplary embodiment Referring to FIG. 3, a heater 114 and electrodes 116 are sequentially formed on a substrate 110. The substrate 110 may be, for example, a silicon substrate. An insulating layer (now shown) may be further formed on the substrate 110. The insulating layer may be formed of, for example, silicon oxide. The heater 114 may be formed by depositing a heating resistor (e.g., a tantalum-aluminum alloy, tantalum nitride, titanium nitride, tantalum silicon nitride or tungsten silicide), and then patterning the heating resistor. The electrodes 116 are formed on the upper surface of the heater 114. The electrodes 116 may be formed by depositing a metal having good conductivity (e.g., aluminum (Al), an aluminum alloy, gold (Au), or silver (Ag)), and then patterning the metal.

Figure 4:
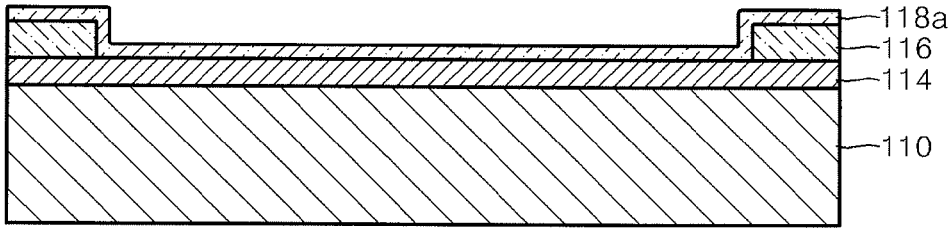
Figure 5:
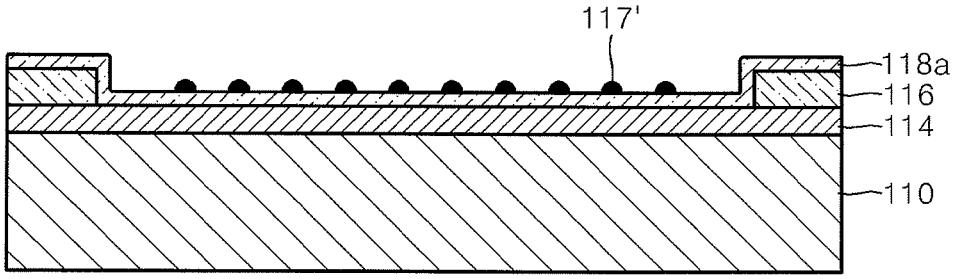

Referring to FIG. 4, a first passivation layer 118*a* is formed on the substrate 110 so as to cover the heater 114 and the electrodes 116. The first passivation layer 118*a* may be formed of, for example, silicon nitride, silicon oxide, aluminum nitride or aluminum oxide. Referring FIG. 5, a catalyst metal pattern 117' to grow CNTs (117 of FIG. 6) is formed on the first passivation layer 118*a*. The catalyst metal pattern 117' may be formed by depositing a catalyst metal material such as nickel (Ni) on the first passivation layer 118*a*, and then patterning the catalyst metal material. The catalyst metal pattern 117' may be formed on a heating portion of the heater 114, that is, a portion of the heater 114 exposed through the electrodes 116.

Figure 6:
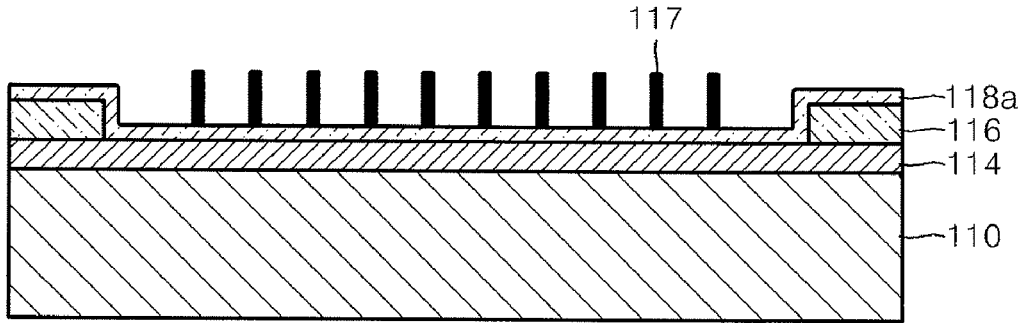

Referring to FIG. 6, the CNTs 117 are grown from the catalyst metal pattern 117'. The CNTs 117 may be formed on the upper portion of the heating portion of the heater 114. The CNTs 117 may be grown using a chemical vapor deposition (CVD). In particular, CVD may include a thermal CVD or a plasma enhanced CVD (PECVD). When the CNTs 117 are grown from the catalyst metal pattern 117' using CVD, the CNTs 117 may be aligned perpendicularly with respect to the surface of the heater 114. The CNTs 117 may each have a height in the range of 0.05 to 1 μm.

Figure 7:
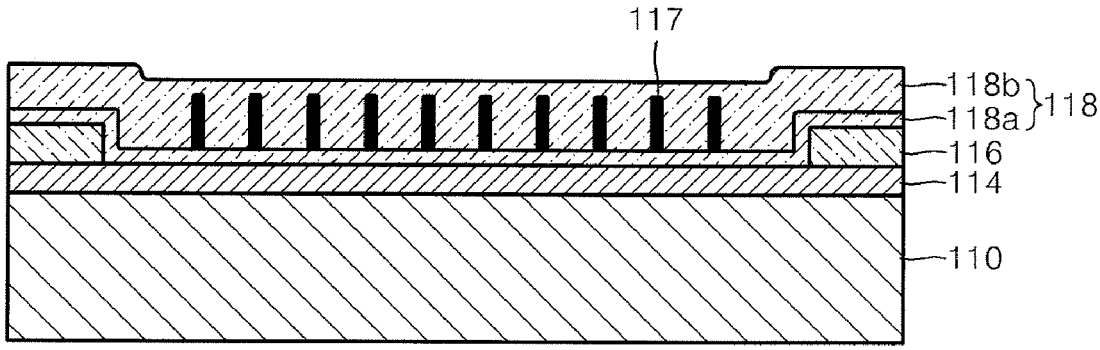

Referring to FIG. 7, a second passivation layer 118*b* is formed on the first passivation layer 118*a* so as to cover the CNTs 117. The second passivation layer 118*b* is formed of the same material as a material to form the first passivation layer 118*a*. Accordingly, the CNTs 117 are disposed in the passivation layer 118 including the first passivation layer 118*a* and the second passivation layer 118*b*.

Figure 8:
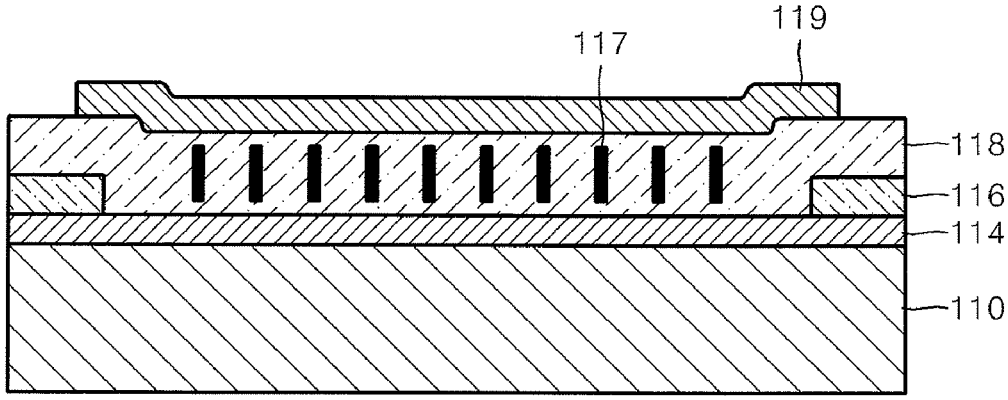

Referring to FIG. 8, the second passivation layer 118*b* is formed, and then an anti-cavitation layer 119 may be further formed on the second passivation layer 118*b*. The anti-cavitation layer 119 may be formed on the second passivation layer 118*b* disposed on the upper portion of the heating portion of the heater 114. The anti-cavitation layer 119 may be formed by depositing, for example, tantalum (Ta) on the second passivation layer 118*b*, and then patterning the tantalum.

Figure 9:
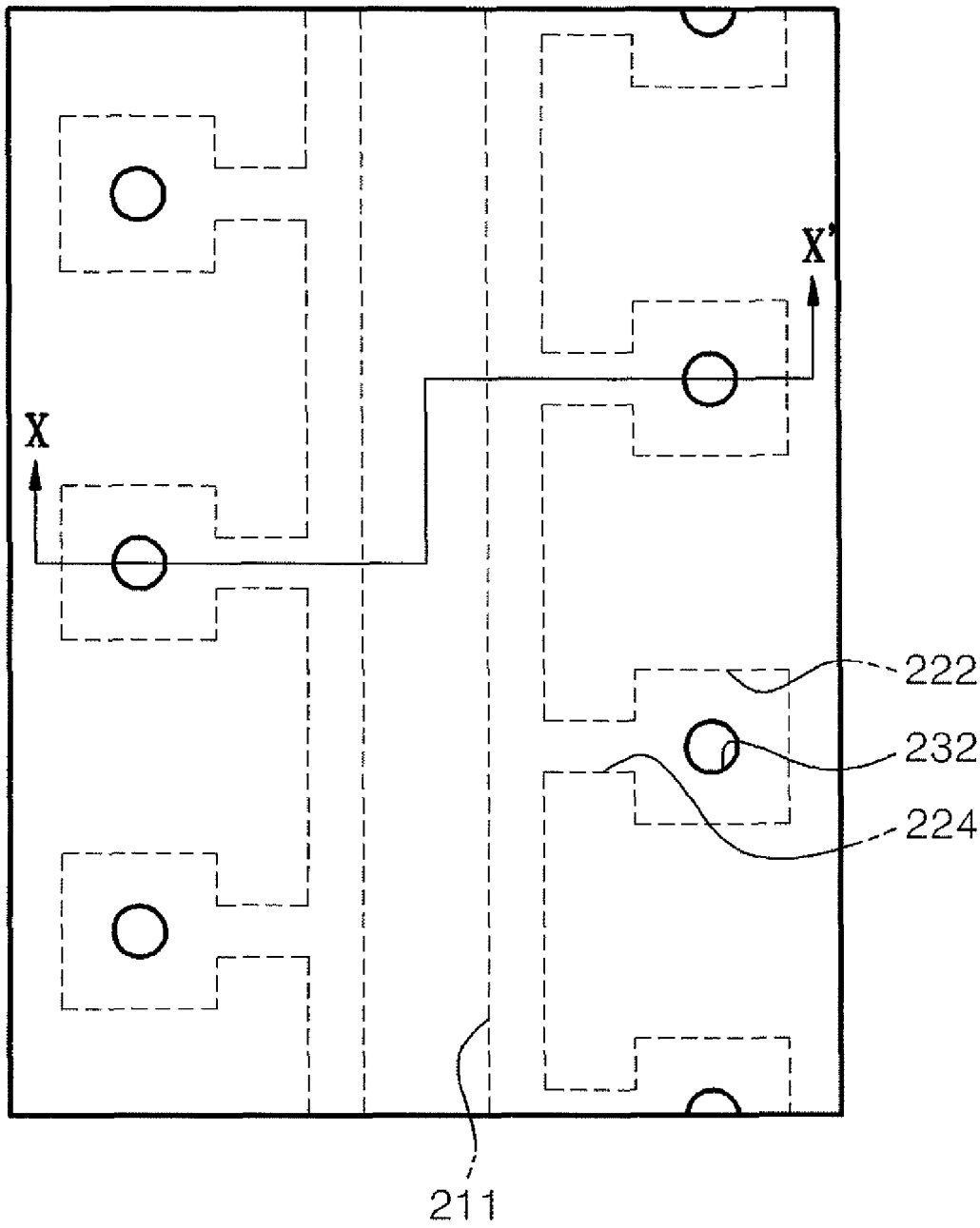
FIG. 9 is a partial schematic plane view illustrating an inkjet printhead according to another embodiment of the present general inventive concept.
Figure 10:
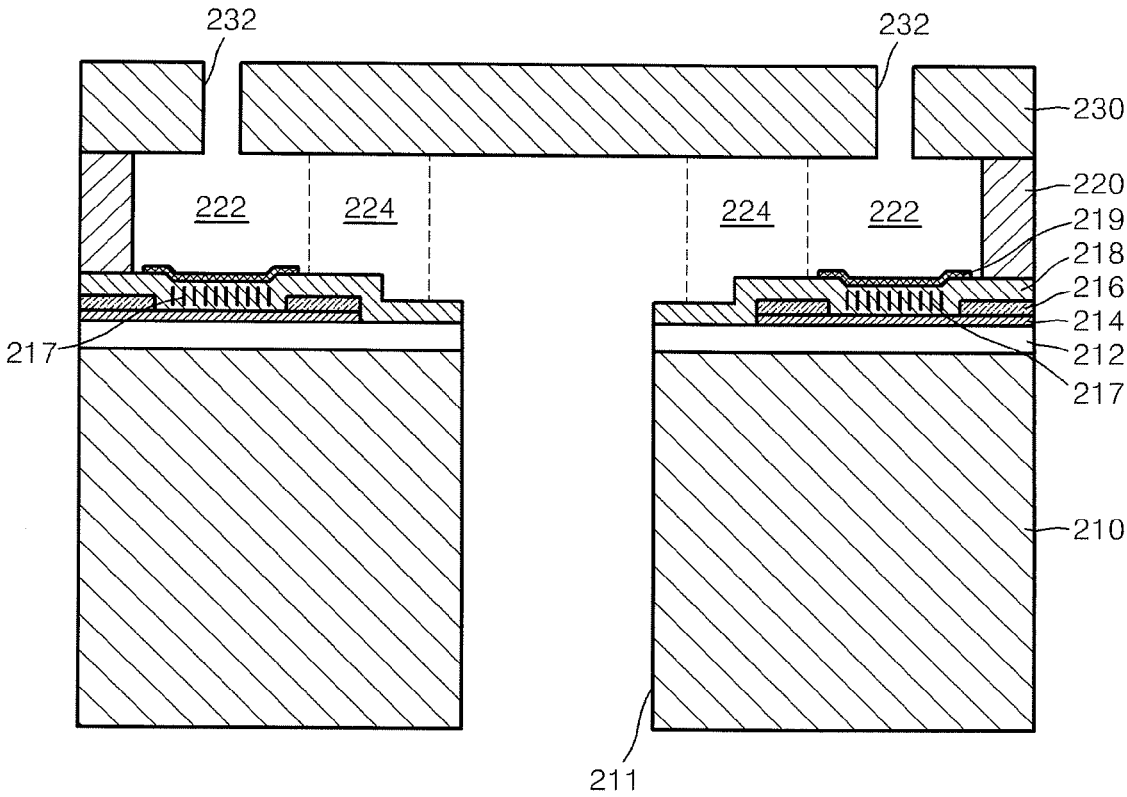
FIG. 10 is a cross-sectional view illustrating the inkjet printhead taken along a line X-X' of FIG. 9.

Hereinafter, an inkjet printhead including the heating structure will be described. FIG. 9 is a partial schematic plan view illustrating an inkjet printhead according to another embodiment. FIG. 10 is a cross-sectional view illustrating the inkjet printhead taken along a line X-X' of FIG. 9.

Referring to FIGS. 9 and 10, a chamber layer 220 and a nozzle layer 230 are sequentially formed on a substrate 210 including a plurality of material layers formed thereon. A plurality of ink chambers 222 are formed in the chamber layer 220, and a plurality of nozzles 232 are formed in the nozzle layer 230. The substrate 210 may be a silicon substrate. An ink feedhole 211 to feed ink is formed through the substrate 210. Although only one ink feedhole 211 is formed through the substrate 210 as illustrated in FIG. 10, the general inventive concept is not limited thereto. That is, two or more ink feedholes may be formed on the substrate 210 as alternative embodiments.

An insulating layer 212 may be formed on the upper surface of the substrate 210. The insulating layer 212 insulates the substrate 210 from the heaters 214, and may be formed of, for example, silicon oxide. A plurality of heaters 214 to heat ink in the ink chambers 222 to generate bubbles are formed on the insulating layer 212. The heaters 214 may be formed of a heating resistor (e.g., a tantalum-aluminum alloy, tantalum nitride, titanium nitride, tantalum silicon nitride or tungsten silicide).

Electrodes 216 are formed on the heaters 214. The electrodes 216 supply currents to the heaters 214, and may be formed of a material having good conductivity (e.g., aluminum (Al), an aluminum alloy, gold (Au), or silver (Ag)). Each ink chamber 222 is disposed above a portion of a heater 214 exposed through the electrodes 216, that is, a heating portion of the heater 214.

A passivation layer 218 is formed on the insulating layer 212 so as to cover the heaters 214 and the electrodes 216. The passivation layer 218 prevents the heaters 214 and the electrodes 216 from oxidizing or corroding due to contacting the ink. The passivation layer 218 may be formed of, for example, silicon nitride, silicon oxide, aluminum nitride, aluminum oxide or the like.

CNTs 217 are formed inside the passivation layer 218. The CNTs 217 may be formed on the upper portion of an exposed portion of each of the heaters 214 through the electrode 216, that is, a heating portion of each of the heaters 214. The CNTs 217 may be formed to be perpendicularly aligned with respect to a surface of the heaters 214. The CNTs 217 may be formed so as not to contact the heaters 214 in order to be insulated from the heaters 214. However, the CNTs 217 may be formed to contact the heaters 214 as an alternative embodiment. For example, the CNTs 217 may be formed to have a height in the range of 0.05 to 1 μm.

An anti-cavitation layer 219 may be further formed on the passivation layer 218. The anti-cavitation layer 219 may be formed on the upper portion of the heating portion of each of the heaters 114. The anti-cavitation layer 219 protects the heaters 214 from a cavitation force which is generated when bubbles burst, and may be formed of, for example, tantalum (Ta).

A chamber layer 220 is stacked on the substrate 210 on which a plurality of material layers, as described above. A plurality of ink chambers 222, which are filled with ink supplied from the ink feedhole 211, are formed in the chamber layer 220. A plurality of restrictors 224 connecting the ink feedhole 211 to the ink chambers 222 may be further formed in the chamber layer 220. A nozzle layer 230 is formed on the chamber layer 220. A plurality of nozzles 232, through which ink from the ink chambers 222 is ejected out, are formed in the nozzle layer 230.

In the inkjet printhead having above structure, since the CNTs 217 formed in the passivation layer 218 have a high conductivity, most heat generated from the heaters 214 can be transferred to the ink in the ink chambers 222 through the CNTs 217. Accordingly, since thermal efficiency of the heaters 214 can be improved, and bubbles can be generated within a short time, performance of the inkjet printhead can be improved. In addition, heat can be prevented from being accumulated in the passivation layer 218, and thus the ejecting property of the inkjet printhead can be improved.

Since CNTs having a high conductivity are formed in a passivation layer, most heat generated from heaters can be transferred to ink. Accordingly, thermal efficiency of the heaters can be improved, and an input energy to generate appropriate bubbles to eject ink can be reduced. Since bubbles can be generated within a short time, performance of the inkjet printhead can be improved.

Further, conventionally, lots of heat generated from the heaters is accumulated in the passivation layer. However, according to the various embodiments described herein, since most heat generated from the heaters is transferred to the ink through the CNTs, heat can be prevented from being accumulated in the passivation layer. Accordingly, the ejecting property of the inkjet printhead can be improved.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A heating structure of an inkjet printhead, comprising:
- a substrate;
- a heater formed on the substrate;
- an electrode formed on the heater;
- a passivation layer formed to cover the heater and the electrode; and
- carbon nanotubes (CNTs) formed in the passivation layer, having a higher thermal conductivity with respect to the passivation layer.

2. The heating structure of claim 1, wherein the CNTs are formed on the upper portion of a heating portion of the heater.

3. The heating structure of claim 1, wherein the CNTs are perpendicularly aligned with respect to a surface of the heater.

4. The heating structure of claim 1, wherein the CNTs are formed to not contact the heater.

5. The heating structure of claim 1, wherein the CNTs are formed to have a height in the range of 0.05 to 1 μm.

6. The heating structure of claim 1, wherein the passivation layer is formed of silicon nitride, silicon oxide, aluminum nitride, or aluminum oxide.

7. The heating structure of claim 1, further comprising:
- an anti-cavitation layer formed on the passivation layer positioned on the upper portion of a heating portion of the heater.

8. The heating structure of claim 7, wherein the anti-cavitation layer is formed of tantalum (Ta).

9. The heating structure of claim 1, wherein the heater is formed of one selected from the group consisting of a tantalum-aluminum alloy, tantalum nitride, titanium nitride, tantalum silicon nitride and tungsten silicide.

10. The heating structure of claim 1, wherein the electrode is formed of aluminum (Al), an aluminum alloy, gold (Au), or silver (Ag).

11. An inkjet printhead comprising:
- a substrate through which an ink feed hole to supply ink is formed;
- a plurality of heaters formed on the substrate, and to generate bubbles by heating ink;
- a plurality of electrodes formed on the heaters, and to supply currents to the respective heaters;
- a passivation layer formed to cover the heaters and the electrodes;
- carbon nanotubes (CNTs) formed in the passivation layer, having a higher thermal conductivity with respect to the passivation layer;
- a chamber layer stacked on the passivation layer, and comprising a plurality of ink chambers formed therein and filled with ink supplied from the ink feedhole; and
- a nozzle layer stacked on the chamber layer, and comprising a plurality of nozzles to eject ink.

12. The inkjet printhead of claim 11, wherein the CNTs are formed on the upper portion of a heating portion of each of the heaters.

13. The inkjet printhead of claim 11, wherein the CNTs are perpendicularly aligned with respect to a surface of the heaters.

14. The inkjet printhead of claim 11, wherein the CNTs are formed to not contact the heaters.

15. The inkjet printhead of claim 11, wherein the CNTs are formed to have a height in the range of 0.05 to 1 μm.

16. The inkjet printhead of claim 11, wherein an insulating layer is formed on the substrate.

17. The inkjet printhead of claim 16, wherein the insulating layer is formed of silicon oxide.

18. The inkjet printhead of claim 11, wherein the heaters are formed of one selected from the group consisting of a tantalum-aluminum alloy, tantalum nitride, titanium nitride, tantalum silicon nitride and tungsten silicide.

19. The inkjet printhead of claim 11, wherein the electrodes are formed of aluminum (Al), an aluminum alloy, gold (Au), or silver (Ag).

20. The inkjet printhead of claim 11, wherein the passivation layer is formed of silicon nitride, silicon oxide, aluminum nitride, or aluminum oxide.

21. The inkjet printhead of claim 11, wherein an anti-cavitation layer is further formed on the passivation layer positioned on the upper portion of a heating portion of the heaters.

22. The inkjet printhead of claim 21, wherein the anti-cavitation layer is formed of tantalum (Ta).

* * * * *